US010366566B1

(12) United States Patent
Pascal et al.

(10) Patent No.: US 10,366,566 B1
(45) Date of Patent: Jul. 30, 2019

(54) SOCIAL NETWORKING GAME WITH NON-RANDOM PRIZES

(71) Applicants: Andrew Pascal, Las Vegas, NV (US); Monty Kerr, Austin, TX (US)

(72) Inventors: Andrew Pascal, Las Vegas, NV (US); Monty Kerr, Austin, TX (US)

(73) Assignee: Playstudios, Inc., Las Vegas, NV (US)

( * ) Notice: Subject to any disclaimer, the term of this patent is extended or adjusted under 35 U.S.C. 154(b) by 0 days.

(21) Appl. No.: 13/767,257

(22) Filed: Feb. 14, 2013

Related U.S. Application Data

(60) Provisional application No. 61/598,767, filed on Feb. 14, 2012.

(51) Int. Cl.
*G07F 17/32* (2006.01)

(52) U.S. Cl.
CPC ..... *G07F 17/3255* (2013.01)

(58) Field of Classification Search
CPC ..... G07F 17/32
USPC ..... 462/25
See application file for complete search history.

(56) References Cited

U.S. PATENT DOCUMENTS

| | | | | |
|---|---|---|---|---|
| 5,761,647 | A | 6/1998 | Boushy | |
| 6,267,671 | B1 | 7/2001 | Hogan | |
| 6,702,673 | B2 | 3/2004 | Webb | |
| 6,883,168 | B1 | 4/2005 | James et al. | |
| 6,965,868 | B1 | 11/2005 | Bednarek | |
| 7,086,947 | B2 | 8/2006 | Walker | |
| 7,419,428 | B2 | 9/2008 | Rowe | |
| 8,177,630 | B2 | 5/2012 | Bryant | |
| 8,568,212 | B2 | 10/2013 | Gagner | |
| 8,597,109 | B2 | 12/2013 | Hermann | |
| 8,657,668 | B1 * | 2/2014 | Coronel et al. | 463/22 |
| 8,986,122 | B2 | 3/2015 | Kelly | |
| 8,992,326 | B2 | 3/2015 | Kelly | |
| 2001/0054003 | A1 * | 12/2001 | Chien et al. | 705/14 |
| 2002/0002075 | A1 | 1/2002 | Rowe | |
| 2002/0151359 | A1 | 10/2002 | Rowe | |
| 2002/0169021 | A1 | 11/2002 | Urie | |
| 2003/0032474 | A1 | 2/2003 | Kaminkow | |
| 2003/0083126 | A1 | 5/2003 | Paulsen | |
| 2003/0083943 | A1 * | 5/2003 | Adams et al. | 705/14 |
| 2003/0171145 | A1 | 9/2003 | Rowe | |
| 2003/0171149 | A1 | 9/2003 | Rothschild | |
| 2004/0097287 | A1 | 5/2004 | Postrel | |
| 2004/0142750 | A1 | 7/2004 | Glisson | |
| 2004/0254005 | A1 | 12/2004 | Shackleford | |
| 2005/0021401 | A1 | 1/2005 | Postrel | |
| 2005/0043992 | A1 | 2/2005 | Cohagan | |
| 2005/0170883 | A1 | 8/2005 | Muskin | |

(Continued)

OTHER PUBLICATIONS

Internet Archive, appeared Apr. 04, 2004, http://web.archive.org/web/20040404125755/www.avicasino.com/xsp/register.xsp.

*Primary Examiner* — Jason Skaarup
(74) *Attorney, Agent, or Firm* — Muskin and Farmer LLC

(57) ABSTRACT

A method, apparatus, and computer readable storage to implement a social networking game that provides players additional incentives and advantages based on the value of that player to a site hosting the games. For example, a player who refers more friends to play on the site will receive better chances of winning valuable prizes in the games. The value of a player's referred friends can also be taken into consideration when determining that player's value.

13 Claims, 5 Drawing Sheets

(56) References Cited

U.S. PATENT DOCUMENTS

| | | | | |
|---|---|---|---|---|
| 2006/0084491 | A1 | 4/2006 | Dicarlo | |
| 2006/0111170 | A1 | 5/2006 | Hornik | |
| 2006/0259361 | A1 | 11/2006 | Barhydt | |
| 2008/0220857 | A1 | 9/2008 | Kelly | |
| 2009/0036202 | A1* | 2/2009 | Baerlocher et al. | 463/25 |
| 2009/0088239 | A1* | 4/2009 | Iddings et al. | 463/20 |
| 2009/0117989 | A1* | 5/2009 | Arezina et al. | 463/20 |
| 2009/0124384 | A1* | 5/2009 | Smith et al. | 463/42 |
| 2010/0062840 | A1* | 3/2010 | Herrmann | 463/25 |
| 2010/0227675 | A1* | 9/2010 | Luxton et al. | 463/25 |
| 2010/0311496 | A1 | 12/2010 | Taylor | |
| 2010/0317424 | A1 | 12/2010 | Hornik | |
| 2011/0059800 | A1* | 3/2011 | Anderson et al. | 463/42 |
| 2011/0269548 | A1* | 11/2011 | Barclay et al. | 463/42 |
| 2012/0028718 | A1 | 2/2012 | Barclay | |
| 2012/0035998 | A1* | 2/2012 | Chien et al. | 705/14.17 |
| 2012/0046090 | A1 | 2/2012 | Halvorson | |
| 2013/0102383 | A1* | 4/2013 | Smith et al. | 463/25 |
| 2013/0145390 | A1* | 6/2013 | Sillerman | 725/18 |
| 2013/0203482 | A1* | 8/2013 | Singer et al. | 463/25 |
| 2014/0038703 | A1* | 2/2014 | Lampert et al. | 463/26 |
| 2014/0135109 | A1* | 5/2014 | Barclay et al. | 463/25 |

* cited by examiner

SOCIAL NETWORKING GAME WITH NON-RANDOM PRIZES

This application claims benefit to U.S. provisional application 61/598,767, which is incorporated by reference herein in its entirety.

BACKGROUND OF THE INVENTION

Field of the Invention

The present general inventive concept is directed to a method, apparatus, and computer readable storage medium directed to a game that can be played on social networking sites, whether accessed via the internet or through mobile devices/channels, that provides players opportunities to receive prizes which are not awarded purely randomly.

Description of the Related Art

Social Internet games are known in the art. Players enjoy the camaraderie of playing games (such as variants of SCRABBLE, BATTLESHIP, etc.) with their friends who may be located far away from each other. Free play online casinos are known in the art as well, where players can play gaming games for credits that do not have cash value. Due to gambling laws, there are some legal and contractual restrictions as to what types of valuable prizes can be awarded to players of social games.

What is needed is a way to award valuable prizes on social networking games without being considered "gambling."

SUMMARY OF THE INVENTION

It is an aspect of the present invention to provide games that favor players and/or award prizes using on non-random elements.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
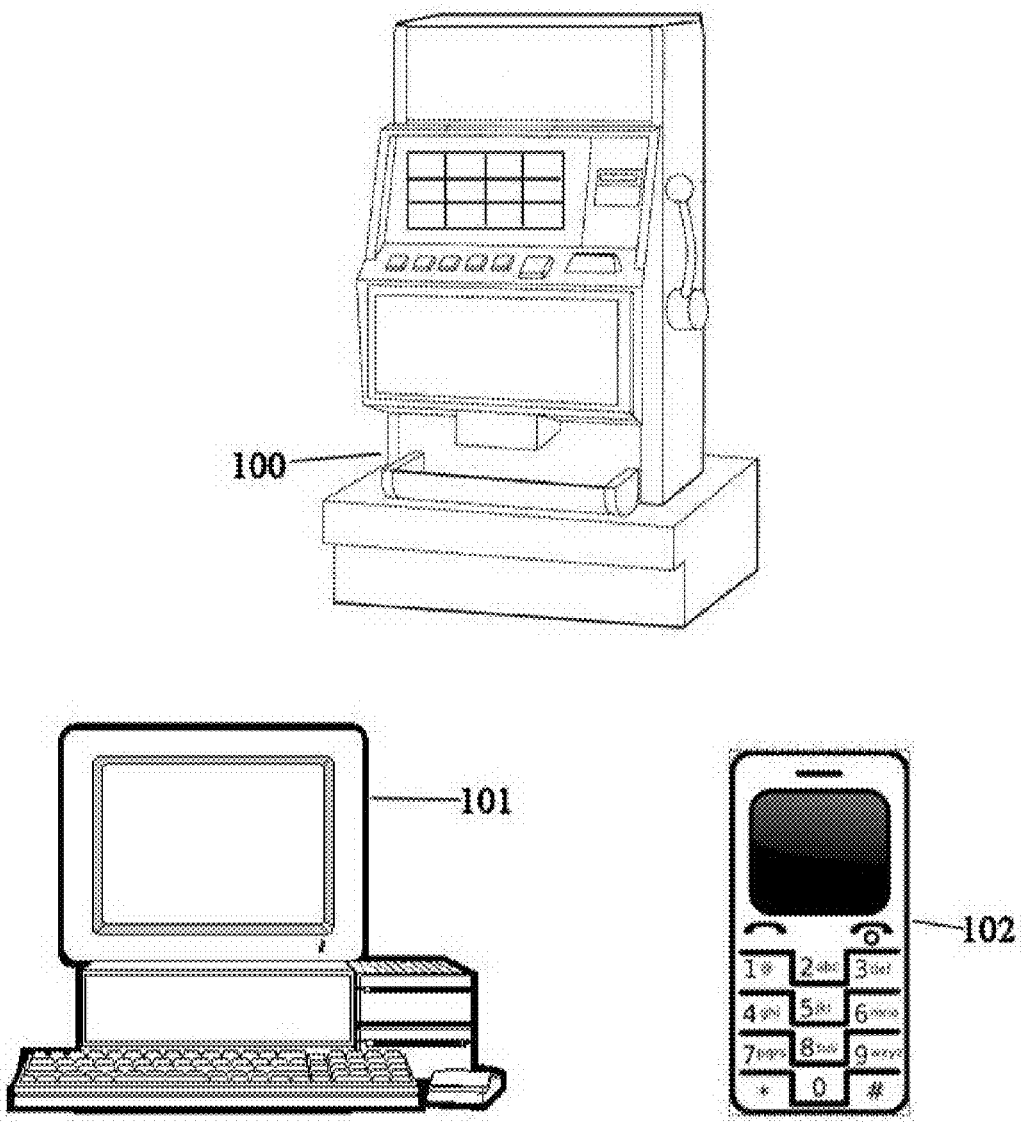
FIG. 1 is a drawing illustrating numerous apparatuses that can play the game described herein, according to an embodiment.

Reference will now be made in detail to the presently preferred embodiments of the invention, examples of which are illustrated in the accompanying drawings, wherein like reference numerals refer to like elements throughout.

The present inventive concept relates to a game that can be played on a social networking site such as FACEBOOK (including what is described in U.S. Pat. No. 7,669,123 which is incorporated by reference herein in its entirety), MYSPACE, or any other site which maintains a database of users and provides an interface for interaction. The game can provide a player with an opportunity to play a game such as slot machine type games, casino games, and other types of games.

There are two types of point values that each player on a gaming site (which can exist as an independent site or an application played on a social networking platform such as FACEBOOK or other delivery mechanism) can possess: credits and loyalty points.

Credits (also referred to as non-cash value credits, non-cash value chips, NCV credits, NCV chips) are used to play each instance of a wagering game but cannot be directly exchanged for cash. For example, a slot game may require a payment of 100 credits in order to spin the slot machine, and if the player wins then the player is awarded in credits. A player can place a "wager" of 50 credits (or $50 in non-cash value chips) on a hand in a virtual blackjack game wherein depending on the outcome, the player would lose the wager or win an award in a same form of the initial "wager" (e.g., the player would win 50 credits or win 50 non-cash value chips). The word "wager" is embedded in quotes because these are not wagers for real money, in that if the player wins, he wins more credits but the credits are not exchangeable for cash (this could run afoul of online gambling laws). Players may be given credits for free (e.g., each player gets 10 free credits each day or week), or players may be given the opportunity to purchase credits for real money (cash). Credits can be purchased using a payment processor which can accept payment via a credit card, PAYPAL account, etc.

Loyalty points (also referred to as loyalty currency) are points that players can earn by their activity on and related to the site. In general, loyalty points are a measure of the value of a player to the site (the more points a player has means the player is more valuable to the site). Examples of ways loyalty points can be earned by a player include: 1) Referring friends to the site (the player can identify a friend to the site (either their email address or clicking their name) and if this friend signs up with the site, this can be considered a referral). Or, a referral can be considered an initial referral from a player to his friend(s) regardless of whether those friends actually sign up with the site. A player can receive a predetermined amount of points per referral (e.g., 20 loyalty points per referral), or a player can receive a predetermined amount of loyalty points per a number of referrals (e.g., when a player refers 10 friends the player gets 100 loyalty points). 2) As an add-on to earning loyalty points based on a number of friends referred, loyalty points can also be determined based on the "quality" (or "value") of those friends. For example, if player's referred friends have a good average "quality" (they play on the site a lot, refer others, spend cash on the site, etc.) then the player would earn more loyalty points because the quality/value of this player's referrals are good. This can be quantified by taking an average of loyalty points of a player's friends and awarding the player this average in additional loyalty points (the average can optionally be multiplied by a constant or other variable). In other words, the quality of a player's referrals can be measured by each of their respective number of loyalty points, and this quality can be used in order to help the player earn additional loyalty points. Of course the better quality of a player's referrals the more additional loyalty points the player will earn, while a worse qualify of a player's referrals the less additional loyalty points the player will earn. The quality (also referred to as value in this context) of a player's referrals can be measured using other mechanisms besides loyalty points, for example, summing the number of referrals of each of the player's referrals; summing a total of cash purchases of the player's referrals, or quantifying any other factor described herein that would measure the quality/value of a player's referrals. For example, Joe referred ten friends who on the average referred two friends each (for a total of 20 new referrals), and Bob referred 3 friends who on the average referred 10 friends each (for a total of 30 new referrals), Bob (if the metric were simply the number of referrals of referrals) would be more valuable to the site than Joe (and in an embodiment Bob would be awarded more loyalty points (e.g., 30 points) than Joe (20 points) if loyalty points were solely measured on referrals of referrals). In a further embodiment, loyalty points can be based on (or incorporate) a player's total derivative referrals (e.g., referrals, referrals of those referrals, and so on). "Derivate referrals" refers to every player who is referred to the site that would not be registered users of the site (assuming they would not have found the site independently) but for the player's entire network of referrals (e.g., Bob's derivative referrals are all of Bob's referrals plus all of Bob's referral's referrals plus all of Bob's referral's referral's referrals, and so on).

Similar to referrals, "derivative cash" is total cash spent on the site by a player's derivative referrals. For example, if all of Joe's derivative referrals spend a total of $2,300 (Joe's derivative cash) in cash on the site, and all of Bob's derivative referrals spend a total of $1,000 (Bob's derivative cash) on the site, then Joe could be considered to have more value to the site than Joe. Loyalty points can be based (or incorporate) a player's derivative cash. In an embodiment, a player can receive loyalty points based on a percentage (e.g., 1%) of that player's derivative cash.

Further ways loyalty points can be earned are: 3) Spending at least a predetermined minimum of time playing games on the site (e.g., if a player spends 50 hours (does not need to be consecutive) playing games (or a particular game) on the site, the player would receive 100 loyalty points). 4) Achieving a particular outcome in a game on the site (e.g., if a player completes a particular level of a hidden object game, the player will earn 25 loyalty points). 5) Purchasing a product advertised on the site (and purchasing it through the site) would earn the player loyalty points, e.g., if a book is advertised on the site and the player purchases the book (clicking the link on the site) using cash, the player can earn 5 loyalty points (or the loyalty points earned can be a percentage of the price of the book, e.g., the player can earn 5% of a purchase price in loyalty points so that buying a book costing $50 will earn the player 2.5 loyalty points).

A player is permitted to purchase credits (e.g., $10 cash for 100 credits) but the player typically would not be permitted to directly purchase loyalty points. In an embodiment, the player would be allowed to convert loyalty points into credits (e.g., 10 loyalty points can be converted into 2 credits) but the player would not be allowed to convert credits into loyalty points (this would effectively be allowing the player to purchase loyalty points which is typically not permitted).

Players can earn loyalty points by taking actions that enhance the value of the product. Loyalty points can be given for sharing in-game events (e.g., clicking a "share" button on a notification which shares a current game outcome with some or all of their friends). The following factors can be used in determining a number of loyalty points to award: A) frequency of share—the more times a player shares, the more loyalty points they would get (e.g., 2 loyalty points per share). There can be a diminishing return for sharing too frequently, e.g., after 10 shares the player would get 1 loyalty points per share (instead of 2). B) Recency of share—the player could get loyalty points based on how recently they shared. There is a diminishing return for sharing too recently; C) Audience size—the player could get loyalty points based on the size of the player's social graph The more friends a player has, the more loyalty the player generates for sharing (e.g., after sharing an outcome, the player earns 0.1 loyalty point per friend the player has (rounded to the nearest loyalty point). D) Expected value—A player with a higher response rate (from the player's friends who can post their responses to the player's message or share) for his messages generates more loyalty per share. For example, a player who gets an average of two responses for the player's messages gets more loyalty points than a player who gets an average of one response for the player's messages (e.g., the number of loyalty points equals 2*the average number of responses the player's messages (e.g., status updates, shares, etc.)

Another way a player can earn loyalty points is by posting achievements or game scores to the games ticker (or news feed or any publicly viewable feed). For example, if the player reaches a particular level in a game (or received a particular outcome) and the player agrees to post the achievement (to his wall, broadcast to the player's friends, etc.) the player will receive additional loyalty points. The same rules discussed above for sharing events can be applied here (e.g., diminishing returns for sharing too frequently, etc.)

Another way a player can earn loyalty points is by when they send invitations (to join the game) and the recipients of those invitations result in some type of positive action by the invitee (merely a player spamming his/her friends typically should not generate additional loyalty points although in another embodiment it can). For example, when the invitees join the player can receive a loyalty point (or multiple of a loyalty point) for each invitee that joins the game.

Another way a player can earn loyalty points is by giving gifts to their friends and receiving gifts back. For example, each gift the player receives back from a friend (that the player sent a gift to) can earn the player a loyalty point. Loyalty points can even be one of the gifts that a player can give (and receive) from/to their friends.

Another way a player can earn loyalty points is by using the "like" function on FACEBOOK (or similar function on any other social networking site). If the player "likes" a game page, the player can receive a number of loyalty points. Similarly, if the player leaves a review for the game (on the game server or another site) the player will receive loyalty points for the leaving the review.

Another way a player can earn loyalty points is based on the amount and quality of play (not the results of play) by the player which can influence the rate at which loyalty currency are earned. Factors that can be used in determining the amount of loyalty points can include: A) frequency of play—if the player returns to the game regularly, this can generate additional loyalty points. If a player returns every day (or multiple times per day), the player generates loyalty faster than a player that has large gaps between sessions. For example, a player who players at least once per day for a week earns 20 additional loyalty points, while a player who plays five to seven times in a week earns 15 additional loyalty points, while a player who plays less than five times in a week earns no additional loyalty points based on this metric. This award (for example) can be computed/award once at the end of each week. B) recency of play—the time since the player's last playing session can impact the amount of loyalty points the player earns. For example, if it has been more than 24 hours since the player's last playing session the player would not earn additional loyalty points based on this metric. If the player returns to the game from 12 to 24 hours since the player's last playing session the player would earn 5 additional loyalty points. If the player returns to the game less than 12 hours from the player's prior playing session the player would receive 10 additional loyalty points. There can be a time minimum (or other play requirement) of each return to the game so the player cannot game the system by continuously returning to the game just to receive points. C) duration of play—the amount of time invest by the player in the game can also affect the number of loyalty points granted. A player who has invested more time in the game would receive more loyalty points. For example, a formula such as: additional loyalty points equal hours in game*0.25 (or any other constant).

Another factor that can be used in determining an award of loyalty points it monetization, in that players that monetize (spend cash) more often would generate loyalty points faster than players that do not monetize. Factors can include: A) promotional bonus—loyalty points can be awarded directly based on purchases, for example, the player receives 10 loyalty points for every $10 cash the player purchases in the game. As another example, the player can be presented with a message such as, "increase your purchase to $19.99 and you will receive 50,000 more game credits and an additional 20 loyalty points"). B) Direct "top off" purchase—if a player is close to redeeming a reward, the game can sell additional loyalty points (in the same manner as selling credits) to the player so they have enough to claim that reward. For example, if the player needs 5,000 loyalty points to earn an award (e.g., a special weapon or a real world award such as a book) and the player only has 4,900 loyalty points, the player can (in an embodiment that allows the selling of loyalty points) be offered the ability to purchase 100 additional loyalty points for cash (or credits) so the player can redeem the award (note however in another embodiment loyalty points cannot be purchased for cash).

In another embodiment, players can gain loyalty points as part of a game currency or premium currency purchase. For example, loyalty points can be awarded as an incentive for upgrading a purchase to a larger (or better return on the player's investment) purchase. For example, a player can purchase 100 credits for $10 (cash) or the player can purchase 200 credits for $15 (cash). The player can receive additional loyalty points for making the latter transaction. Once the player has selected a bundle size (e.g., the number of credits to purchase for a specified amount of cash), the player can be presented with a "special offer" which can offer additional credits or loyalty points (if the embodiment being implemented allows for the direct sale of loyalty points) for an additional amount of cash (e.g., $1). For example, if the player is about to purchase 100 credits for $10, the player can be presented with a pop-up window stating "for an additional $5 ($15 total purchase) you can purchase another 100 credits (200 total) plus 50 loyalty points" in order to entice the player with an "impulse buy." Or, loyalty points can be included as an incentive to the player to purchase a particular "bundle" (combination of credits and loyalty points for a particular cash amount, for example, the player can be offered the following bundles: "1—$10 for 100 credits; 2—$20 for 200 credits plus 10 additional loyalty points." Or the player can be offered the following bundles—"1—$10 for 100 credits; 2—$15 for 200 credits; 3—$20 for 300 credits plus 20 loyalty points."

Another way players can earn loyalty points is when the player engages in offers from the game or through in-game advertising. For example, if the player clicks an ad in the game and makes a purchase based on the ad, the player can earn additional loyalty points. In an embodiment, if the player clicks an ad and watches a video, the player can earn loyalty points even if the player does not actually buy anything.

Loyalty points can be used (paid) by the player (to the site) in order to redeem incentives (from the site). Loyalty points can be redeemed in the following ways: 1) Loyalty points can be used for entries into a lottery or sweepstakes or raffle type of game, e.g., each loyalty point can be exchanged for one entry in the lottery/sweepstakes (which can award cash or other valuable prizes), so for example 100 loyalty points would be exchanged for 100 entries into the lottery/sweepstakes. The lottery/sweepstakes can pick a number of random entries out of all of the entries entered into the lottery/sweepstakes to be awarded prize(s). 2) Loyalty points can be directly exchanged for cash or valuable prizes (e.g., 1000 loyalty points can be exchanged for a particular model of digital camera). 3) Loyalty points can be exchanged into credits (e.g., 2 loyalty points can be exchanged for 1 credit). 4) Loyalty points can be used to purchase certain advantages on the site. For example, 100 loyalty points could buy an advantage on the game (e.g., in a dungeons and dragons type of game, an advantage could be a more powerful weapon). 5) Loyalty points can be used to unlock particular levels, e.g., a particular level on a game (e.g., a location on a hidden object game) is not freely available to players unless the player unlocks that level by paying a predetermined number of loyalty points.

One example of a "master formula" for determining a number of loyalty points awarded to a player can be as follows:

$$\text{Loyalty points}=(2*N+4*S+P*7+C*2+Q*4)/19.$$

wherein N=number of friends referred, S=number of those friends that have actually registered with the site, P=amount of cash purchases made by the player, H=number of hours the player has played on the site, C=number of links on the site the player has clicked, Q=average number of loyalty points of the friends referred that have registered with the site. This is of course just one example, and any other formula can be used to determine loyalty points. In an embodiment, instead of a composite value for loyalty points (as described above), different values (types) of loyalty points can be maintained for each player (e.g., one value of loyalty points based on the player's friends, another value of loyalty points based on the player's activity) and these can be used in any manner described herein. A loyalty point amount can be computed from only one factor up (e.g., solely based on a number of friends referred) to a composite of any number of factors (including any combination of factors discussed herein or others not discussed).

Figure 2:
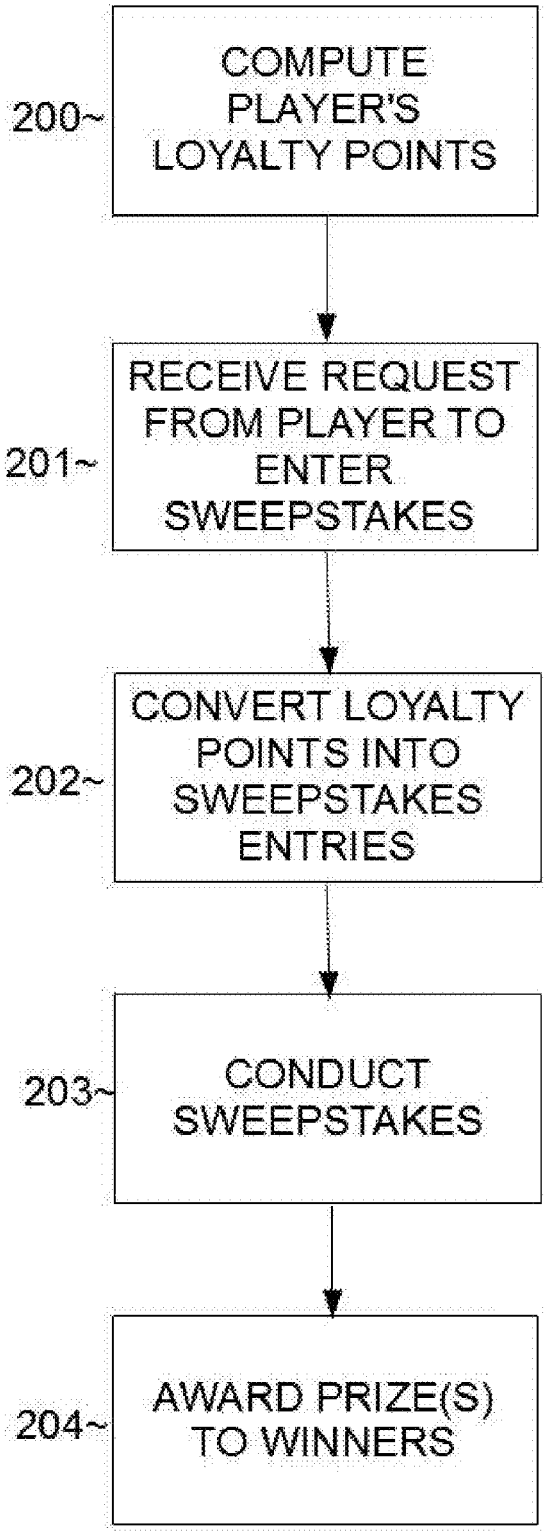
FIG. 2 is a flowchart illustrating an exemplary method of converting loyalty points into sweepstakes entries, according to an embodiment.

FIG. 2 is a flowchart illustrating an exemplary method of converting loyalty points into sweepstakes entries, according to an embodiment. This method (and all methods described herein) can be performed on a server associated with the site (which can be working in communication with the social network site which would typically be controlled by a different server).

In operation 200, the number of loyalty points for a player is computed. This can be done each time the amount of loyalty points is needed (since the player's history and all of the data needed to computer the loyalty points is all stored). Alternatively, the amount of loyalty points can be computed on a "rolling" basis, that is, a running total is kept and each action that occurs that would earn the player additional loyalty points (e.g., the player has referred a friend), this would add a respective number of loyalty points to the player's total number of loyalty points.

From operation, the method proceeds to operation 201, which receives a request from the player to enter the sweepstakes. Note the order of operations 200 and 201 can also be reversed. The player can make this request for example by using a graphical user interface (GUI) and click respective icons (or type respective text) as needed to indicate the players desire to enter a sweepstakes using the player's loyalty points. The player would typically be presented with the player's amount of loyalty points and the player can optionally be prompted to enter how many of the player's loyalty points does the player wish to convert to sweepstakes entries (e.g., if the player has 1,000 loyalty points the player may wish to only use 500 of those points for entries into the Sweepstakes).

From operation 201, the method proceeds to operation 202, which converts the loyalty points into sweepstakes entries. There can be a conversation ratio (e.g., ten loyalty points equals one sweepstakes entry) or there can be a ratio of 1 (one loyalty point equals one sweepstakes entry). Of course the player's total number of loyalty points is deducted by the amount of points converted into entries. When points are converted into entries, each entry can be stored in a database (or record) on a server so that each player's entries are recorded and that the total number of entries is easily tabulated and maintained.

From operation 202, the method proceeds to operation 203, which conducts the sweepstakes. The sweepstakes can pool all of the entries from players (it does not matter how those entries were earned, e.g., some may have been converted upon request of players and other players may have been the entries in games) into a single pool and a predetermined number (the number of winners) of entries are randomly picked from the pool. Different picks could have different prizes associated with them (e.g., the first ten picks will win $50 cash and the eleventh pick will win a new car). Each entry in the Sweepstakes would typically have an equal chance of being picked. This type of sweepstakes can also be considered a raffle game.

From operation 203, the method proceeds to operation 204, which awards the prizes to their respective winners. The winners can be informed as such via an instant message, email message, etc. Physical prizes can be mailed to the player's home and intangible prizes (e.g., cash, gift certificates, etc.) can be delivered electronically to the player.

Loyalty points can also be used in two ways, depending upon the embodiment being implemented. In one embodiment, loyalty points can be a discrete quantity possessed by a player (similar to the player's number of credits) and the number of loyalty points can be "spent" on various items (entering into lottery/sweepstakes games, used for purchasing prizes, etc. in which the spent amount of loyalty points is deducted from the player's total loyalty points) In another embodiment, a player's number of loyalty points is used more for internal purposes in order provide the player advantages to games based on the player's number of loyalty points. In this embodiment, players may be given "grades" based on their respective number of loyalty points. For example, a table such as Table I below can be used to determine a player's grade (also referred to as category). In this embodiment, typically the player's loyalty points do not decrease (are not "spent") when it is used for advantages/incentives/prizes, although some conditions can trigger a decrease (e.g., if the player is inactive for a predetermined period of time (e.g., six months) the player would lose half of his/her loyalty points.

TABLE I

| Loyalty points | category |
|---|---|
| <100 | novice |
| 100-400 | member |
| 400-1000 | preferred member |
| >1000 | VIP |

Thus, a player who has 150 loyalty points would be considered a "member." Players can receive additional advantages in games based on their category. Different games can have different advantages based on their category. For example, in a dungeons and dragons type of game, a player's shield strength can be 10 for a novice, 50 for a member, 100 for a preferred member, and 150 for a VIP. In another embodiment, discrete categories are not necessary and players can be given their advantages based on their number of loyalty points (e.g., a player's shield strength in a dungeons and dragons type of game is equal to 10 plus the number of loyalty points the player has).

Other ways a player's number of loyalty points can be used is as follows. In a poker game, a player with more loyalty points can be given better cards (e.g., more likely to get an ace). In a poker game, a player with more (or at least a predetermined number of) loyalty points can be given (occasionally or always) the opportunity to view some (or all) of his/her opponents cards (which during standard poker (and if the player did not have the required number of loyalty points) the player would not be permitted to see). In a blackjack game, a player with more (or at least a predetermined number of) loyalty points can be given advantages, such as the player wins on ties (instead of pushing). In a slot game, if a player has more (or at least a predetermined number of) loyalty points the player would be more likely to receive a wild symbol when the reels stop spinning Or in a slot game, if a player has more (or at least a predetermined number of) loyalty points the player would receive bigger awards (an improved paytable). Or in a slot game, if a player has more (or at least a predetermined number of) loyalty points, he would qualify for different reel mappings (some more favorable than others). For example, each of the categories in Table I can have associated with it a different reel mapping (the higher the category, the more favorable to the player), and when player plays a particular slot machine that machine would use its respective reel mapping (typically the player would not be aware of the different reel mappings). Along the same lines, each category can have associated with it its own paytable (some more favorable than others), and the respective paytable is used when the slot game is played (e.g., a royal flush on a video poker game for the novice category would pay the standard 250, a royal flush for the member category would pay 300, a royal flush for the preferred member category would pay 500, and a royal flush for the VIP would pay 1000, assuming all categories otherwise use a standard paytable (e.g., jacks or better—1/two pair—2/three of a kind—3/straight—4/flush—6/full house—9/four of a kind 25/straight flush—50/royal flush—250).

Figure 3:
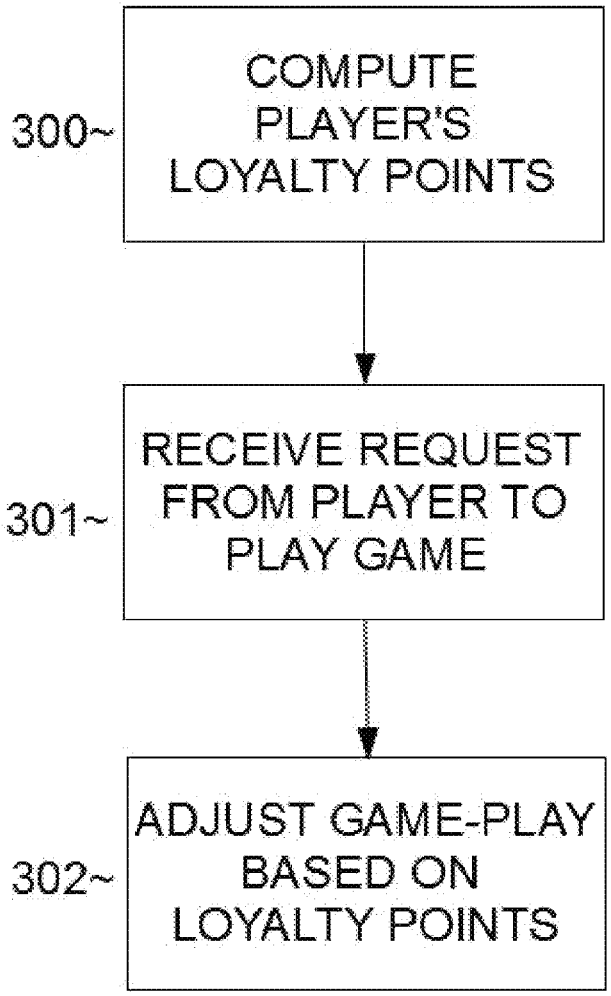
FIG. 3 is a flowchart illustrating an exemplary method of adjusting game-play based on a player's loyalty points, according to an embodiment.

FIG. 3 is a flowchart illustrating an exemplary method of adjusting game-play based on a player's loyalty points, according to an embodiment.

In operation 300, the player's loyalty points are computed. See operation 200 (and the entire application) for more on how this can be accomplished.

From operation 300, the method proceeds to operation 301, wherein a player's request to initiate (play) a particular game is received. This can be done as known in the art, for example the player can use a GUI to click a particular slot machine (or other game) the player wishes to play.

From operation 301, the method proceeds to operation 302, which adjusts the game-play based on the player's loyalty points. This can be done as described herein. For example, based on the player's loyalty points, the player can be given a different reel mapping (for a slot game), a different paytable (for a slot game, video poker game, or any other game that uses a paytable), can provide the player advantages (e.g., a stronger character in a dungeons and dragons or fighting game, etc.) or any other adjustment to any game that would be in the player's interest when the player qualifies by having at least a predetermined number of loyalty points. Another advantage the player can receive is the player can be more likely to receive higher value symbols (e.g., a wild symbol or other symbols that are favorable to the player) with a higher number of loyalty points. For example, a novice player (from Table I) may receive a wild symbol on a slot game (or a joker card in a video poker game) one out of every 10 games, while a preferred member (from Table I) may receive a wild symbol on a slot game (or a joker card in a video poker game) one out of every 5 games.

Casino games on a casual gaming web site typically cannot allow players to play for real money (cash). Valuable prizes can be awarded to players but valuable prizes typically cannot be awarded based on outcomes of games (which can be played by the payment of credits) because this would be tantamount to gambling (since credits can be purchased with money and are used to play games). However, indirect mechanisms can be used in order to award players valuable prizes without their award being directly dependent upon an outcome of a random game.

In an embodiment, valuable awards can be awarded to the player but valuable awards cannot be awarded based on random results which are triggered by a payment of credits (because this may be tantamount to gambling). However, valuable awards can be awarded based on a determination that is independent of the game that is currently being played by the player. For example, a player who has more than a predetermined number of loyalty points would be predetermined to win a prize (e.g., a $5 coupon for AMAZON.COM). When the player goes to play a slot machine type game on the site, the reels on the slot machine would stop on a combination that would award the player the $5 coupon (or any other valuable prize). The player may not realize that this result was "pre-determined" as the spin of the slot game would appear to the player as if it was any other spin. A table (such as Table II below) can map levels of loyalty points to valuable prizes. When a player is awarded the valuable prize, either the respective number of loyalty points is deducted from the player's number of loyalty points or that valuable prize is just removed from the prizes that will be awarded to the player based on this paradigm (but there is no deduction).

TABLE II

| Loyalty points | Prize |
|---|---|
| 100 | $5 coupon for AMAZON.com |
| 500 | $20 cash |
| 5,000 | digital camera model 123 |
| 25,000 | Bahamas vacation |

Thus, for example, in Table II, when a player earns 100 loyalty points, the next time he plays a slot machine game on the site (or a particular slot machine game) the reels will stop on a combination that awards a $5 coupon for AMAZON. The player would continue to earn loyalty points (the 100 points would not be deducted although in another embodiment it can be) and when the player earns 500 loyalty points and players the slot machine game on the site the reels will stop on a combination that awards $20 cash to the player. The player may (or may not) know that these prizes are "predetermined." Table III represents a paytable that can be used with this embodiment which awards particular prizes from Table II (and others). Each spin of this slot machine game may cost 50 credits (or any other number).

TABLE III

| Combination | Award |
|---|---|
| 7-7-7 | 10,000 credits |
| airplane/airplane/airplane | Bahamas vacation |
| bar/bar/bar | 1,000 credits |
| orange/orange/orange | 25 credits |
| camera/camera/camera | digital camera |
| any two 7's | $20 cash |
| any one 7 | $5 coupon for AMAZON |

Figure 4:
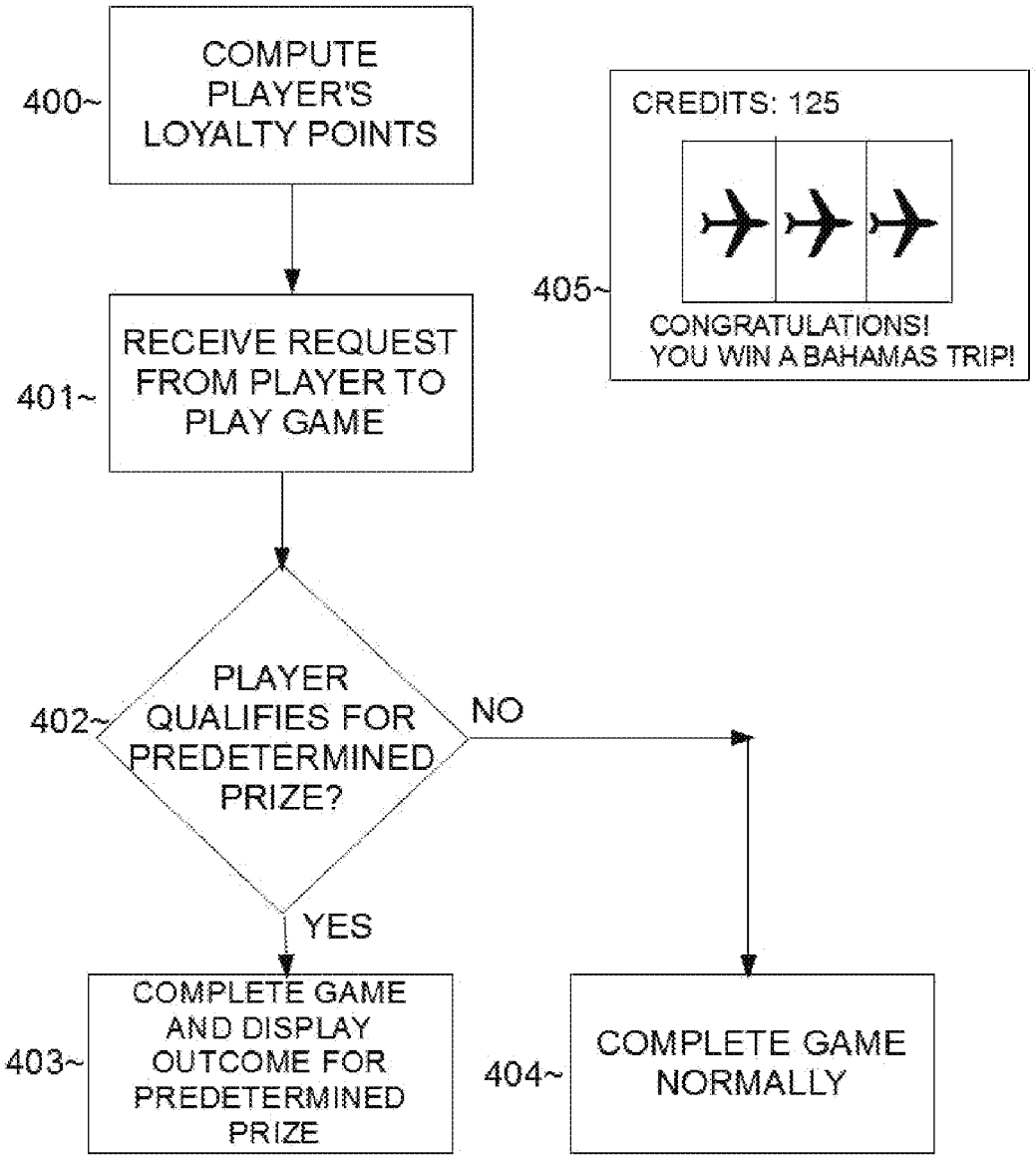
FIG. 4 is a flowchart illustrating an exemplary method of awarding a predetermined prize on a game, according to an embodiment.

FIG. 4 is a flowchart illustrating an exemplary method of awarding a predetermined prize on a game, according to an embodiment.

In operation 400, the player's loyalty points are computed. See operation 200 and the entire description herein for more detail on this. This is not a requirement for this method if the award of the predetermined prize (in operation 402) does not use the amount of loyalty points.

From operation 400, the method can proceed to operation 401, which receives a request from a player to play a particular game (e.g., a slot game, video poker game, casino table game, etc.)

From operation 401, the method proceeds to operation 402, which determines whether the player qualifies for a predetermined prize (if the player does not satisfy the stated condition then the player would not qualify). This determination can be performed in numerous ways. In one embodiment, if the player has at least a predetermined amount of loyalty points, then the player would be entitled to a predetermined prize.

In another embodiment, the player's loyalty points do not have to be used in order to make the determination of whether the player qualifies for a predetermined prize. In an embodiment, if the player has completed a predetermined activity (e.g., received at least a particular score on a game or completed a certain level), the player could qualify for the predetermined prize. In another embodiment, if the player has taken an action such as logging into the site (or playing a particular game) at a particular time, the player would qualify for a predetermined prize. In another embodiment, if the player's name meets a predetermined condition (e.g., the player's initials are two randomly picked letters) and the player logs into the site (or players the game) during a particular time range, the player would qualify for the predetermined prize. In another embodiment, if the player referred at least a particular number of friends then the player would qualify for the predetermined prize (this is equivalent to having loyalty points determined solely on the number of friends the player has referred and using the loyalty points as the qualifying condition as discussed above).

If in operation 402, the player did meet the stated condition (criteria) to qualify for the predetermined prize (award), then the method proceeds to operation 403, wherein the game games is completed and the outcome displayed is not really random but is "reverse mapped" based on the predetermined prize awarded. For example, if the player is to earn a Bahamas vacation (from Table II) on a slot game, then the outcome the slot game will display the symbols on the final result as airplane/airplane/airplane (see Table III). The symbols would spin and the player would typically not know that this prize was predetermined to be awarded to the player (thus in this case the reels do not stop at random outcomes). Sample slot output 405 illustrates a slot game window where the player received this outcome.

If in operation 402, the player did not meet the stated condition (criteria) to qualify for the predetermined prize (award), then the method proceeds to operation 404, wherein the game proceeds and is completed normally (for example, if the game is a slot type game, then the reels stop at random positions an award, if earned, is awarded based on the final symbol combination). It is noted that even though the player did not qualify for a predetermined award, the player can still win any of the prizes on the paytable if the player coincidentally receives that outcome. For example, if the player is lucky enough to receive three airplanes, then the player can still win the Bahamas trip.

Figure 5A:
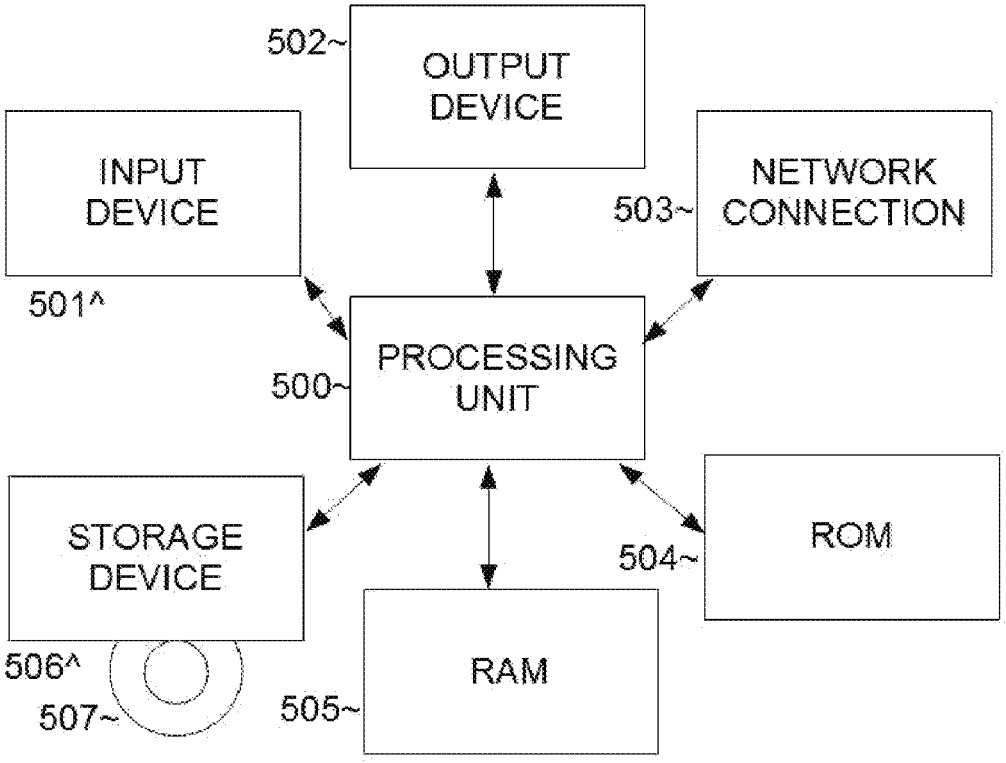
FIG. 5A is a block diagram illustrating exemplary hardware that can be used to implement the game described herein, according to an embodiment.

FIG. 5A is a block diagram illustrating exemplary hardware that can be used to implement the game described herein, according to an embodiment. The hardware in FIG. 5A can be used to implement a computer implementing the game described herein and/or a server that is serving the game to a computer which is displaying the game to a player. Such a server can interface with a social networking site (e.g., FACEBOOK, MYSPACE, etc.) that is used to coordinate the entire game and communicate with the players as well as a server used by the social network site.

A processing unit 500 can be a microprocessor and associated structure (e.g., bus, cache, clock, etc.) which can be connected to an input device (e.g., touch-screen, keyboard, mouse, buttons, etc.), and an output device (e.g., touch-screen, CRT, monitor, etc.) The processing unit 500 can also be connected to a network connection 503 which can connect to a computer communications network such as the Internet, Wi-Fi, LAN, WAN, etc. The processing unit 500 can also be connected to a ROM 504 and a RAM 505 as used in the art. The processing unit 500 can also be connected to a storage device 506 which can be nonvolatile storage device (e.g., BLU-RAY drive, CD-ROM drive, hard drive, EPROM, etc.) A computer readable medium 507 (e.g., BLU-RAY disc, CD-ROM, hard disc, etc.) can be read by the storage device 506 and can store programs and assets that can cause the processing unit 500 to perform any of the methods described herein. The ROM and RAM can also be loaded with instructions that can cause the processing unit 500 to perform any of the methods described herein.

Figure 5B:
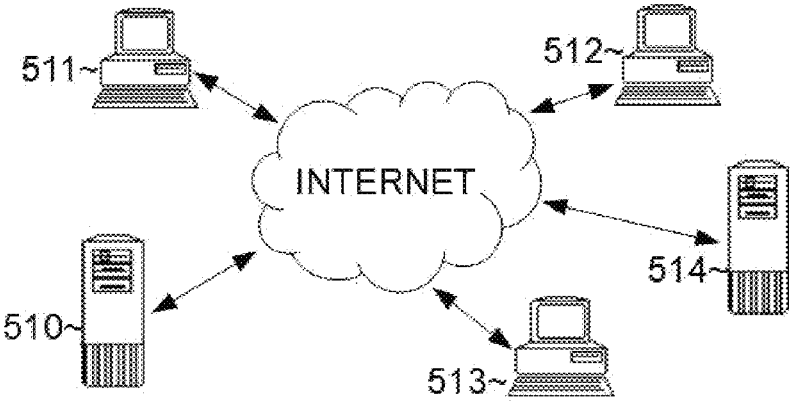
FIG. 5B is a network diagram showing a network structure for a social networking web site and players, according to an embodiment.

FIG. 5B is a network diagram showing a network structure for a social networking web site and players, according to an embodiment.

A computer communications network (such as the Internet) can be used to connect a host server 510 which can host and serve a social networking site. Note that while FIG. 5B shows only one server as the host server 510, the host server 510 can encompass numerous servers all cooperating with each other (whether in the same physical location or not). The host server 510 communicates with players 511, 512, 513 through the Internet (or other computer communication network) and can implement any of the methods herein by executing computer code programmed accordingly. Game server 514 can also implement all games and methods described herein on the site by executing computer code programmed accordingly. The game server 514 is connected to the Internet and can communicate with all of the players 511, 512, 513 directly or indirectly through the social networking site hosted by the host server 510. The game server 514 can cooperate with the host server 510 so that the games run on the game server 514 can be integrated into the social networking site hosted by the host server 510. The game server can also be optional and all of the games can be also hosted on the host server 510, whereby the integration of the games served/hosted by the game server 514 will appear embedded in the social networking site hosted by the host server 510 such that players would typically not realize (or care) that multiple servers are cooperating in order to play games on the social networking site. All of the communications described herein can be effectuated using such a network configuration. Typically, the communications are effectuated on the social networking site itself, thus the players 511, 512, 513 should be logged into the social networking site in order to participate herein, although logging in is not required (e.g., communications can be transmitted using other methods, such as email, IRC chat, instant message, etc.) The host server 510 can communicate with any of the devices illustrated in FIG. 1.

Note that described herein are a number of different methods how a number of loyalty points can be computed and awarded to a player. It is noted that a loyalty point formula can combine any number (and any selection) of the features described herein and optional weights can be applied. For example, a player can earn X*number of hours the game is played plus Y*number of friends referred, wherein X and Y are constants (weights) set by the game designers. The computation of loyalty points can be done immediately, upon certain actions by the player (e.g., entering or leaving the game), periodically (e.g., midnight each night, weekly, etc.) or at any other point.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All features described herein (including all documents incorporated by reference) can be combined with one another without limitation. While the "credits" are used herein to refer to awards provided to players typically refers to non-cash value credits, this can also refer to cash credits as well (that are directly redeemable for cash).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement a game, the method comprising:

providing a game server which cooperates with a host server which hosts and serves a social networking site, the game server connects to a plurality of remote computers via the Internet and executes computer readable instructions on an electronic processing unit which causes:

determining an amount of loyalty points earned by a player using one of the plurality of remote computers;

receiving a request by the player to initiate the game;

determining that the player qualifies for a predetermined prize;

determining the predetermined prize based on the amount of loyalty points;

determining a predetermined combination of symbols that corresponds to the predetermined prize; and displaying and conducting the game comprising spinning reels and stopping the reels on the predetermined combination of symbols.

2. The method as recited in claim 1, wherein the amount of loyalty points is determining using a number of friends the player has referred to the game server.

3. The method as recited in claim 1, wherein the amount of loyalty points is determined using a number of friends the player has referred to the gamer server that have signed up with the game server.

4. The method as recited in claim 1, wherein the amount of loyalty points is determined using an amount of loyalty points of friends referred to the game server by the player.

5. The method as recited in claim 1, wherein the request by the player to initiate the game includes receiving a payment by the player of a credit amount from player credits.

6. The method as recited in claim 5, wherein the player is offered an opportunity to convert loyalty points into an award having a monetary value.

7. The method as recited in claim 6, wherein the player is offered an opportunity to convert loyalty points into credits.

8. The method as recited in claim 5, wherein the player is offered an opportunity to convert loyalty points into credits.

9. The method as recited in claim 1, wherein the more loyalty points a player has the greater an expected value for the player.

10. A method to implement a game, the method comprising:

providing a game server which cooperates with a host server which hosts and serves a social networking site, the game server connects to a plurality of remote computers via the Internet and executes computer readable instructions on an electronic processing unit which causes:

receiving an action by a player unrelated to the game, the player using one of the plurality of remote computers;

receiving a request by the player to initiate the game;

determine that the player qualifies for a predetermined prize;

determine the predetermined prize based on the action;

determine a predetermined combination of symbols that corresponds to the predetermined prize; and displaying and conducting the game comprising spinning reels and stopping the reels on the predetermined combination of symbols.

11. The method as recited in claim 10, wherein the action is the player referring at least a predetermined number of friends.

12. The method as recited in claim 10, wherein the action is the player received at least a predetermined score.

13. A method to implement a game, the method comprising:

providing a game server which cooperates with a host server which hosts and serves a social networking site, the game server connects to a plurality of remote computers via the Internet and executes computer readable instructions on an electronic processing unit which causes:

enabling a player to log into a game site during a particular range in time, the player using one of the plurality of remote computers;

receiving a request by the player to initiate the game;

determining that the player qualifies for a predetermined prize;

determining the predetermined prize based on the player logging in during a particular range in time;

determining a predetermined combination of symbols that corresponds to the predetermined prize; and displaying and conducting the game comprising spinning reels and stopping the reels at the predetermined combination.

* * * * *